US010900506B2

(12) United States Patent
Kim

(10) Patent No.: US 10,900,506 B2
(45) Date of Patent: Jan. 26, 2021

(54) CONSTRUCTION MACHINE

(71) Applicant: Doosan Infracore Co., Ltd., Incheon (KR)

(72) Inventor: Tae Yoon Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 16/472,008

(22) PCT Filed: Dec. 20, 2017

(86) PCT No.: PCT/KR2017/015088
§ 371 (c)(1),
(2) Date: Jun. 20, 2019

(87) PCT Pub. No.: WO2018/117626
PCT Pub. Date: Jun. 28, 2018

(65) Prior Publication Data

US 2019/0331144 A1 Oct. 31, 2019

(30) Foreign Application Priority Data

Dec. 21, 2016 (KR) ..... 10-2016-0175789

(51) Int. Cl.
*F15B 21/0427* (2019.01)
*E02F 9/22* (2006.01)

(52) U.S. Cl.
CPC ..... *F15B 21/0427* (2019.01); *E02F 9/22* (2013.01); *F15B 2211/20576* (2013.01)

(58) Field of Classification Search
CPC ..... F15B 11/17; F15B 21/0427; E02F 9/22
See application file for complete search history.

(56) References Cited

U.S. PATENT DOCUMENTS 4,373,869 A * 2/1983 Martin ..... F04B 49/24 417/213
7,207,173 B2 * 4/2007 Nakata ..... F15B 21/042 374/E3.007

(Continued)

FOREIGN PATENT DOCUMENTS

JP 1996-284907 A 11/1996
JP 2000074011 A 3/2000

(Continued)

OTHER PUBLICATIONS

Extended European Search Report for related European Application No. 17883116.0; action dated Dec. 18, 2019;(8 pages).

(Continued)

*Primary Examiner* — Michael Leslie
(74) *Attorney, Agent, or Firm* — K&L Gates LLP

(57) ABSTRACT

A construction machine includes: one or more hydraulic pumps discharging a working fluid; an engine supplying a rotational power to the hydraulic pumps; a hydraulic line through which the working fluid discharged by the hydraulic pumps moves; a main control valve provided on the hydraulic line and controlling supply of the working fluid to a traveling device or one or more of various working devices, which require the working fluid; a bypass cut valve provided on the hydraulic line at a lower side thereof than the main control valve to open and close the hydraulic line; an automatic warm-up switch generating a warm-up operation signal for raising a temperature of the working fluid before an operation starts; and a control device performing a warm-up operation for increasing the number of revolutions of the engine and opening the bypass cut valve to increase a flow rate along the hydraulic line, when the warm-up operation signal is received from the automatic warm-up switch.

17 Claims, 4 Drawing Sheets

(56) References Cited

U.S. PATENT DOCUMENTS

| | | | | |
|---|---|---|---|---|
| 8,234,860 | B2 * | 8/2012 | Beschorner | E02F 9/2235 60/329 |
| 8,726,648 | B2 * | 5/2014 | Sato | E02F 9/2235 60/431 |
| 9,169,829 | B2 * | 10/2015 | Nomaguchi | F03D 7/02 |
| 9,340,950 | B2 * | 5/2016 | McWethy | F15B 21/042 |
| 9,803,333 | B2 * | 10/2017 | Horii | E02F 3/425 |
| 10,450,723 | B2 * | 10/2019 | Osaka | H01M 10/625 |
| 10,523,482 | B2 * | 12/2019 | Chaudhuri | H04W 72/121 |
| 2010/0050621 | A1 | 3/2010 | Beschorner et al. | |
| 2015/0316078 | A1 | 11/2015 | Son et al. | |

FOREIGN PATENT DOCUMENTS

| | | | |
|---|---|---|---|
| JP | 2016148378 | A | 8/2016 |
| KR | 101251006 | B1 | 4/2013 |
| KR | 20150092161 | A | 8/2015 |

OTHER PUBLICATIONS

International Search Report for related International Application No. PCT/KR2017/015088; report dated Jun. 28, 2018;(5 pages).
Written Opinion for related International Application No. PCT/KR2017/015088; report dated Jun. 28, 2018; (6 pages).

* cited by examiner

CONSTRUCTION MACHINE

CROSS-REFERENCE TO RELATED APPLICATIONS

The present application is a National Stage of International Application No. PCT/KR2017/015088, filed Dec. 20, 2017, which claims priority to Korean Application No. 10-2016-0175789, filed Dec. 21, 2016, the disclosure of which is incorporated herein by reference.

TECHNICAL FIELD

Embodiments of the present invention relate to a construction machine, and more particularly, to a construction machine using a hydraulic pressure.

BACKGROUND ART

A construction machine refers to all machines used in civil engineering works or construction works. In general, a construction machine includes an engine and a hydraulic pump driven on the power generated by the engine. Such a construction machine runs on the power generated by the engine and the hydraulic pump, or drives working devices.

For example, an excavator is a kind of construction machineries that performs excavation works for digging the ground, loading works for transporting soil, shredding works for dismantling buildings, clean-up works for organizing the ground in the civil engineering, building, and construction sites. Such an excavator includes a carriage which serves to transport equipment, an upper turning body mounted on the carriage and rotated 360 degrees, and a working device.

In addition, such an excavator includes a travel motor used for travelling, a swing motor used for swinging the upper turning body, and driving devices such as a boom cylinder, an arm cylinder, a bucket cylinder, and an optional cylinder used in the working device. These driving devices are driven by a working fluid supplied from a hydraulic pump.

The excavator further includes an operation device including, for example, a joystick, an operation lever, and a pedal for controlling the aforementioned various driving devices.

When working with the construction machine such as an excavator in winter or in cold climates, a preparation work is required to raise the temperature of a working fluid to a temperature suitable for operation of the machinery before starting operations. This is generally called warm-up operation. That is, when a worker gets in the driver's seat, starts up the engine, and lifts up the safety lever which is vertically rotatably provided on the side of the driver's seat, the safety solenoid valve is turned on. Then, by operating the operation lever, it may be switched into a work preparation stage in which working devices such as a boom may be operated.

In such a case, in order to raise the temperature of the engine or the temperature of the working fluid as quickly as possible, the pressure of the hydraulic pump is raised to the maximum up to a relief pressure. In addition, the operation lever is operated in a boom-up or arm-in/out manner to allow the working fluid of the hydraulic pump to flow so that the hydraulic pump may be operated at the maximum output condition, and accordingly, the temperature of the working fluid may be increased.

However, when the worker stops operating the operation lever, the main control valve returns to the initial state, and the working fluid supplied by the hydraulic pump returns to the oil tank along a center bypass flow path of the main control valve. That is, since a load is not generated in the hydraulic pump, the temperature rise of the working fluid is slowed down. Accordingly, in order to raise the temperature of the working fluid during the winter season, the worker should continuously operate the operation lever in one direction, so the worker may take considerable troubles and inconvenience.

In addition, in order to raise the temperature of the working fluid or the temperature of the engine to be suitable for operations in winter, the worker should only operate the operation lever continuously for about 30 to 40 minutes, without doing other specific works, so the time is wasted.

DETAILED DESCRIPTION OF INVENTION

Technical Problem

Aspects of embodiments of the present invention may be directed to a construction machine capable of allowing a worker to easily raise a temperature of a working fluid to a temperature suitable for operation of hydraulic equipment before starting operations.

Solution to Problem

According to an embodiment of the present invention, a construction machine includes: one or more hydraulic pumps discharging a working fluid; an engine supplying a rotational power to the hydraulic pumps; a hydraulic line through which the working fluid discharged by the hydraulic pumps moves; a main control valve provided on the hydraulic line and controlling supply of the working fluid to a traveling device or one or more of various working devices, which require the working fluid; a bypass cut valve provided on the hydraulic line at a lower side thereof than the main control valve to open and close the hydraulic line; an automatic warm-up switch generating a warm-up operation signal for raising a temperature of the working fluid before an operation starts; and a control device performing a warm-up operation for increasing the number of revolutions of the engine and opening the bypass cut valve to increase a flow rate along the hydraulic line, when the warm-up operation signal is received from the automatic warm-up switch.

The construction machine may further include: an oil tank storing the working fluid to be supplied to the hydraulic pump, and retrieving the working fluid that has been discharged from the hydraulic pump and moving along the hydraulic line; and a heating device raising the temperature of the working fluid stored in the oil tank. When the control device receives the warm-up operation signal, the control device may drive the heating device before increasing the number of revolutions of the engine and opening the bypass cut valve.

The construction machine may further include: a cooling fan that receives the rotational power from the engine to operate. When the control device receives the warm-up operation signal, the control device may change the number of revolutions of the cooling fan to a minimum number of revolutions or stop the cooling fan, before opening the bypass cut valve.

The hydraulic pump may include therein an angle sensor capable of measuring a swash plate angle, and be electronically controlled by an electric signal generated by the control device. The control device may be capable of forcibly adjusting the swash plate angle of the hydraulic pump based on information transmitted by the angle sensor.

When the temperature of the working fluid reaches a predetermined reference temperature after the control device increases the number of revolutions of the engine and opens the bypass cut valve, the control device may forcibly adjust the swash plate angle of the hydraulic pump to further increase a flow rate and a pressure of the working fluid moving along the hydraulic line.

The automatic warm-up switch may generate one of a normal warm-up operation signal, a rapid warm-up operation signal, and a fuel efficiency warm-up operation signal as the warm-up operation signal. The control device may select one of a normal mode, a rapid mode, and a fuel efficiency mode according to the type of the warm-up operation signal received from the automatic warm-up switch and performs the warm-up operation.

When the normal mode is selected, the control device may increase the number of revolutions of the engine and an opening ratio of the bypass cut valve gradually or stepwisely, as the temperature of the working fluid increases, may forcibly drive the hydraulic pump to discharge the working fluid at a flow rate and a pressure that are lower than a maximum flow rate and a maximum pressure, respectively, when the temperature of the working fluid reaches a first reference temperature after the number of revolutions of the engine is increased and the bypass cut valve is open, and may gradually or stepwisely increase the flow rate and the pressure of the working fluid discharged from the hydraulic pump to the maximum flow rate and the maximum pressure, respectively, when the temperature of the working fluid reaches a second reference temperature that is higher than the first reference temperature.

When the fuel efficiency mode is selected, the control device may delay a point in time for increasing the number of revolutions of the engine and opening the bypass cut valve as compared to that in the normal mode, or slow down a speed for increasing the number of revolutions of the engine and increasing an opening ratio of the bypass cut valve as compared to that in the normal mode.

When the rapid mode is selected, the control device may lower the first reference temperature and the second reference temperature than those in the normal mode, respectively.

In a case where a current altitude at the time of performing the warm-up operation is substantially equal to or higher than a predetermined altitude, the control device may slow down a speed for increasing the number of revolutions of the engine and increasing an opening ratio of the bypass cut valve as compared to that in the normal mode, and lower the first reference temperature and the second reference temperature than those in the normal mode, respectively.

Advantageous Effects of Invention

According to embodiments of the present invention, a construction machine allows a worker to easily raise a temperature of a working fluid to a temperature suitable for operation of hydraulic equipment before starting operations.

DESCRIPTION OF EMBODIMENTS

Figure 1:
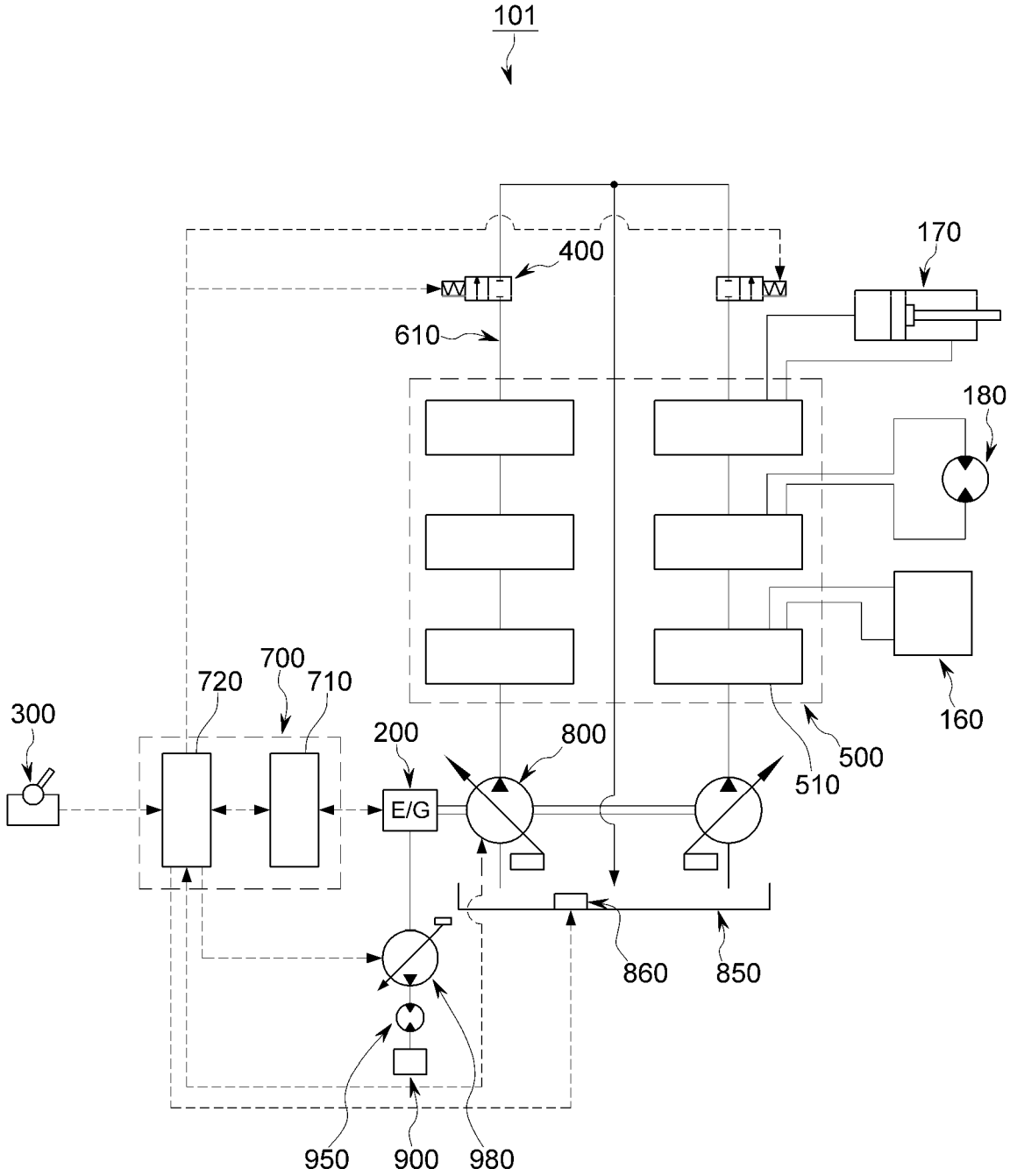
FIG. 1 is a configuration diagram illustrating a construction machine according to a first embodiment of the present invention.

Exemplary embodiments will now be described more fully hereinafter with reference to the accompanying drawings. Although the invention may be modified in various manners and have several embodiments, embodiments are illustrated in the accompanying drawings and will be mainly described in the specification. However, the scope of the present invention is not limited to the embodiments and should be construed as including all the changes, equivalents and substitutions included in the spirit and scope of the present invention.

In addition, in various embodiments, components having the same configuration are represented by the same reference symbols in a first embodiment, and in other embodiments, only the configurations different from those of the first embodiment will be described.

It should be understood that the drawings are schematic and they are not drawn to scale. The relative dimensions and ratios of the components illustrated in the drawings are exaggerated or reduced in size for clarity and convenience of illustration in the drawings, and the dimensions are merely illustrative and not restrictive. The same reference numerals are used for the same structure, element or component appearing in more than one drawing to denote similar features.

The embodiments of the present invention specifically illustrate ideal embodiments of the present invention. Accordingly, various variations or modifications of the illustration are expected. Thus, the embodiments are not limited to any particular form of the depicted area, but include modifications of the form, for example, by manufacturing.

Hereinafter, a construction machine 101 according to a first embodiment of the present invention will be described with reference to FIG. 1. In the first embodiment of the present invention, an excavator will be described as the construction machine 101 by way of example. However, the first embodiment of the present invention is not limited thereto, and it may be applied to any construction machine 101 that transmits power by a working fluid discharged by a hydraulic pump.

As illustrated in FIG. 1, the construction machine 101 according to the first embodiment of the present invention includes a hydraulic pump 800, an engine 200, a hydraulic line 610, an oil tank 850, a main control valve (MCV) 500, a bypass cut valve 400, an automatic warm-up switch 300, and a control device 700.

In addition, the construction machine 101 according to the first embodiment of the present invention may further include various working devices and traveling devices. In addition, the construction machine 101 may include an operating device such as a joystick, an operation lever, and a pedal installed in a driver's cab to allow a worker to operate the various working devices 170 and the traveling devices 160. The aforementioned automatic warm-up switch 300 may be one kind of the operating devices.

In addition, the construction machine 101 according to the first embodiment of the present invention may further include a heating device and a cooling fan 900. In addition, the construction machine 101 may further include, for example, a cooling fan drive pump 980 and a cooling fan drive motor 950.

The engine 200 generates power by burning a fuel. That is, the engine 200 supplies rotational power to the hydraulic pump 800 to be described below.

The hydraulic pump 800 runs on the power generated by the engine 200 and discharges a working fluid. The working fluid discharged from the hydraulic pump 800 is supplied through the hydraulic line 610, to be described below, to the traveling device 160 that includes a travel motor used for traveling, a swing motor 180 that is used for swinging an upper turning body, and driving devices such as a boom cylinder, an arm cylinder, a bucket cylinder, and an optional cylinder that are used in the various working devices 170. These driving devices are driven by the working fluid supplied from the hydraulic pump 800.

In the first embodiment of the present invention, the hydraulic pump 800 may include therein an angle sensor (not illustrated) capable of measuring a swash plate angle, and may be electronically controlled by an electric signal generated by the control device 700 to be described below. In such a case, information measured by the angle sensor is transmitted to the control device 700. Accordingly, the control device 700 may forcibly adjust the swash plate angle of the hydraulic pump 800 based on the information transmitted by the angle sensor. That is, the hydraulic pump 800 may be forcibly driven only by the electric signal generated by the control device 700.

The hydraulic line 610 allows the working fluid discharged from the hydraulic pump 800 to move, and supplies the working fluid discharged from the hydraulic pump 800 to the traveling device 160, the swing motor 180, and the driving devices such as a boom cylinder, an arm cylinder, a bucket cylinder, and an optional cylinder that are used in the various working devices 170.

The oil tank 850 supplies the working fluid to be discharged by the hydraulic pump 800. The oil tank 850 retrieves the working fluid discharged from the hydraulic pump 800 and flowing along the hydraulic line 610.

A heating device 860 heats the working fluid stored in the oil tank 850 to raise a temperature thereof. In the first embodiment of the present invention, the heating device 860 may be installed in a variety of configurations and methods known in the art. For example, the heating device 860 may be an electric hot wire installed inside the oil tank 850.

The main control valve 500 is provided on the hydraulic line 610, and controls supply of the working fluid to the traveling device 160, the swing motor 180, or one or more of the various working devices 170 that require hydraulic pressure. That is, the main control valve 500 distributes the working fluid discharged by the hydraulic pump 800 to the various working devices 170, the swing motor 180, and the traveling device 160, and controls the supply of the working fluid.

Specifically, the main control valve 500 includes a plurality of control spools 510. Each of the control spools 510 controls the supply of the working fluid to the traveling device 160, the swing motor 180, and the driving devices such as a boom cylinder, an arm cylinder, a bucket cylinder, and an optional cylinder that are used in the various working devices 170.

In addition, the main control valve 500 may further include spool caps (not illustrated) respectively connected to opposite ends of the control spool 510 to receive a pilot signal of the operating device and stroke the control spool 510. For example, the spool cap may be provided with an electronic proportional pressure reducing valve (EPPRV). In such a case, a pressure applied to the control spool 510 by the pilot signal which is transmitted as a pressure of the working fluid varies according to a degree of opening and closing of the EPPRV, and the control spool 510 moves in opposite directions by the pressure applied by the pilot signal.

The bypass cut valve 400 is provided on the hydraulic line 610 at a lower side thereof than the main control valve 500 so as to open and close the hydraulic line 610.

When the bypass cut valve 400 is switched to a closed state, the working fluid discharged from the hydraulic pump 800 is prevented from moving along the hydraulic line 610 and returning to the oil tank 850. On the other hand, when it is switched to an open state, the working fluid discharged from the hydraulic pump 800 may return to the oil tank 850.

That is, when the bypass cut valve 400 is in the closed state, a flow rate of the working fluid moving along the hydraulic line 610 may not increase even though the hydraulic pump 800 operates.

The cooling fan 900 cools the working fluid and a cooling water of the engine 200. The cooling fan 900 is required to cool down the cooling water of the engine 200 and the working fluid whose temperature rises unnecessarily as the construction machine 101 is operating. However, when the temperature of the working fluid is lower than a temperature suitable for operation of the hydraulic equipment, the operation of the cooling fan 900 may rather have an adverse effect. That is, during a startup or warm-up operation, the operation of the cooling fan 900 may have an adverse effect.

The cooling fan drive pump 980 is driven by receiving rotational power from the engine 200 and drives the cooling fan drive motor 950. The cooling fan drive motor 950 rotates the cooling fan 900.

However, the first embodiment of the present invention is not limited thereto, and the cooling fan 900 may rotate by various methods known in the art. That is, the cooling fan 900 may receive rotational power directly from the engine 200. In such a case, the cooling fan drive pump 980 and the cooling fan drive motor 950 may be omitted.

The automatic warm-up switch 300 generates a warm-up operation signal for raising the temperature of the working fluid before starting operations. The warm-up operation signal generated by the automatic warm-up switch 300 is transmitted to the control device 700, which will be described below.

The control device 700 controls various configurations of the construction machine 101 such as the engine 200, the main control valve 500, and the hydraulic pump 800. The control device 700 may include at least one of an engine control unit (ECU) 710 and a vehicle control unit (VCU) 720.

In particular, in the first embodiment of the present invention, when the control device 700 receives the warm-up operation signal from the automatic warm-up switch 300, the control device 700 controls various equipment to perform a warm-up operation.

In such a case, the control device 700 first checks the temperature of the cooling water of the engine 200 before performing the warm-up operation for raising the temperature of the working fluid. In a case where the temperature of the cooling water of the engine 200 does not reach a suitable temperature, the engine 200 is preheated.

Figure 2:
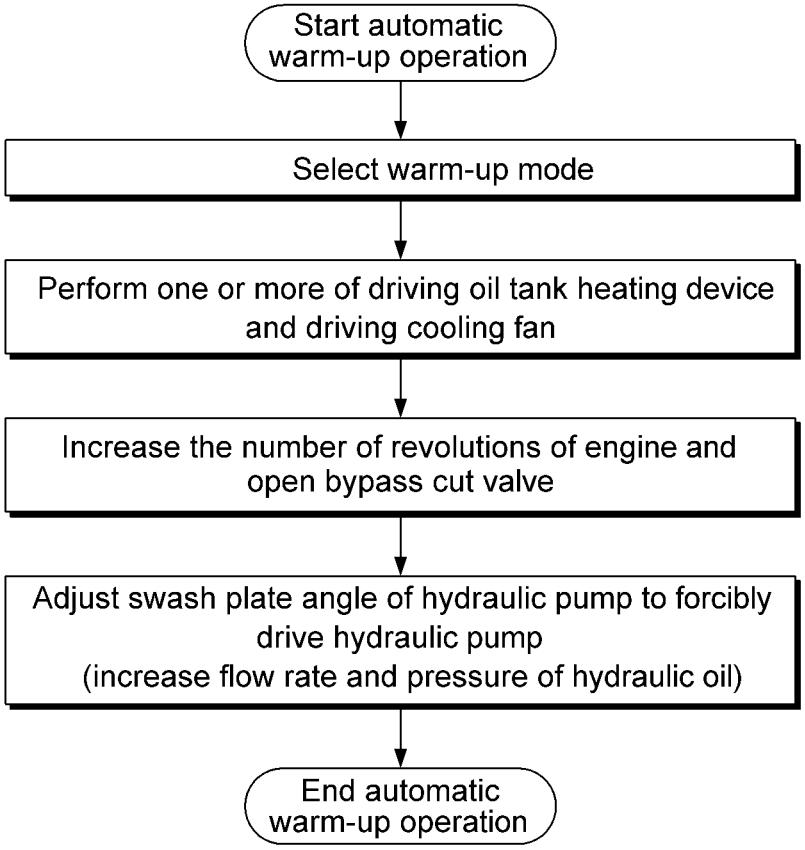
FIG. 2 is a flowchart showing a warm-up operation sequence of the construction machine of FIG. 1.

Hereinafter, the warm-up operation performed by the control device 700 will be described in detail with reference to FIG. 2.

First, the control device 700 drives the heating device 860 to raise the temperature of the working fluid stored in the oil tank 850.

Then, the control device 700 changes the number of revolutions of the cooling fan 900 to a minimum number of revolutions, or stops the cooling fan 900. However, when the cooling fan drive pump 980 is used to rotate the cooling fan 900, a load is generated during operation of the cooling fan drive pump 980 to help increase the temperature of the working fluid. Thus, it is preferable to keep the number of revolutions of the cooling fan 900 to the minimum, than stopping the cooling fan 900.

Next, the control device 700 increases the number of revolutions of the engine 200 and an opening ratio of the bypass cut valve 400 gradually or stepwisely, as the temperature of the working fluid increases.

As described above, when the number of revolutions of the engine 200 is increased and the flow rate along the hydraulic line 610 is increased by opening the bypass cut valve 400, the temperature of the working fluid increases. In such a manner, the control device 700 performs an initial warm-up operation.

Thereafter, when the temperature of the working fluid reaches a first reference temperature, the control device 700 adjusts the swash plate angle of the hydraulic pump 800 to forcibly drive the hydraulic pump 800. For example, the first reference temperature may be set to be substantially equal to or lower than about 10 degrees Celsius.

In the first embodiment of the present invention, the hydraulic pump 800 may be forcibly driven by the electric signal generated by the control device 700, and the swash plate angle of the hydraulic pump 800 may be adjusted to a desired angle based on the information transmitted by the angle sensor embedded in the hydraulic pump 800.

The control device 700 forcibly drives the hydraulic pump 800 to discharge the working fluid at a flow rate and a pressure that are lower than a maximum flow rate and a maximum pressure, respectively, at the first reference temperature. For example, the flow rate and the hydraulic pressure of the working fluid discharged from the hydraulic pump 800 that is forcibly driven may each be about 50% of the maximum flow rate and the maximum hydraulic pressure, respectively.

When the hydraulic pump 800 is forcibly driven to increase the flow rate and the pressure of the discharged working fluid, a large load may be generated over the hydraulic pump 800 and the working fluid is heated more quickly.

As such, the temperature of the working fluid may be rapidly raised by forcibly driving the hydraulic pump 800, but when the hydraulic pump 800 is forcibly driven from the beginning, the hydraulic equipment may be damaged.

However, according to the first embodiment of the present invention, the hydraulic pump 800 is forcibly driven after the temperature of the working fluid is raised to some extent through methods of driving the heating device 860, the minimum revolution of the cooling fan 900, increasing the number of revolutions of the engine 200, and increasing the opening ratio of the bypass cut valve 400, and accordingly, the temperature of the working fluid may be effectively raised while substantially preventing damage to the hydraulic equipment.

Thereafter, when the temperature of the working fluid rises and reaches a second reference temperature which is higher than the first reference temperature, the control device 700 gradually or stepwisely increases the flow rate and the pressure of the working fluid, generated by the hydraulic pump 800, to the maximum flow rate and the maximum pressure. For example, the second reference temperature may be set within a range higher than about 10 degrees Celsius and substantially equal to or lower than about 20 degrees Celsius.

When the temperature of the working fluid rises sufficiently, that is, when it reaches a warm-up operation end temperature, the control device 700 ends the warm-up operation and returns to the control operation for performing operations. For example, the warm-up operation end temperature may be set within a range higher than about 20 degrees Celsius and substantially equal to or lower than about 40 degrees Celsius.

Table 1 below summarizes the warm-up operation performed by the control device according to the first embodiment of the present invention.

TABLE 1

| Sequence | 1 | 2 | 3 | 4 | 5 |
|---|---|---|---|---|---|
| Operation target | Oil tank heating device | Cooling fan | Engine | By pass cut valve | Forcibly control flow rate and pressure of oil discharged from hydraulic pump |
| Warm-up start | Drive | Rotate with minimum number of revolutions | Increase number of revolutions gradually or stepwisely | Increase opening ratio gradually or stepwisely | — |
| First reference temperature | Drive | Rotate with minimum number of revolutions | | | Drive below maximum level |
| Second reference temperature | Drive | Rotate with minimum number of revolutions | | | Drive at maximum level |
| Warm-up operation end temperature | End warm-up operation and return to control operation to perform operations | | | | |

With such a configuration, the construction machine 101 according to the first embodiment of the present invention may easily raise the temperature of the working fluid to a temperature suitable for operation of the hydraulic equipment automatically before a worker starts operations.

In addition, according to the first embodiment of the present invention, not only may the construction machine 101 automatically perform the warm-up operation for raising the temperature of the working fluid, it may perform the warm-up operation in three divided steps so that it is possible to suppress the occurrence of damage to the hydraulic equipment during the warm-up operation.

Figure 3:
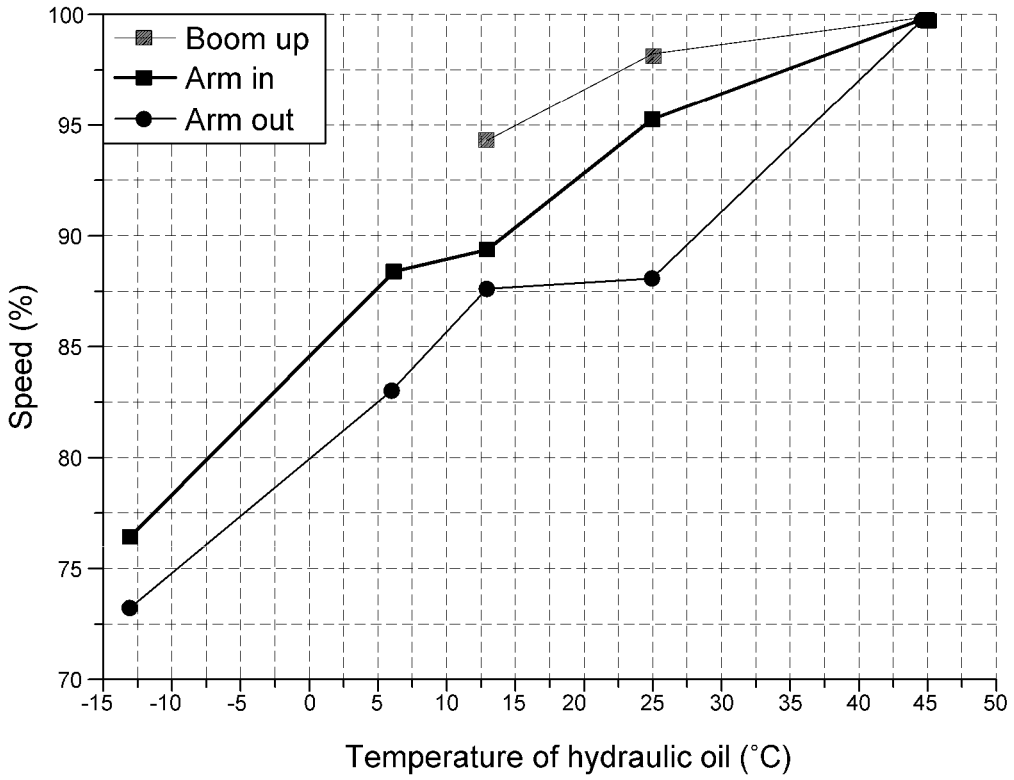
FIG. 3 is a graph showing a performance speed of a working device according to a temperature of a working fluid.

In addition, it may be appreciated from FIG. 3 that when the temperature of the working fluid is raised by performing the warm-up operation, the speed of the working device is increased and the working efficiency is greatly improved.

Hereinafter, a second embodiment of the present invention will be described with reference to FIG. 4.

Figure 4:
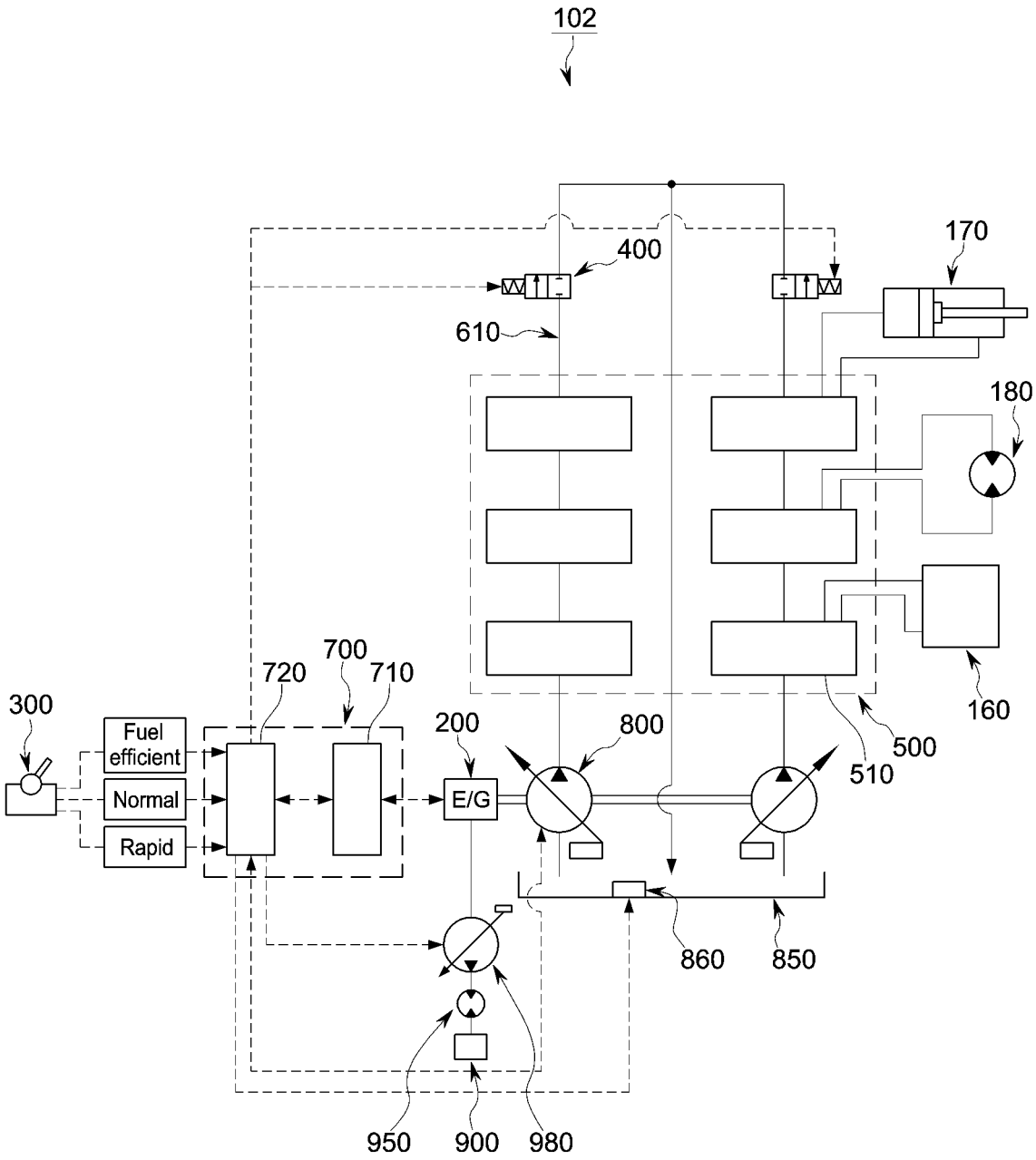
FIG. 4 is a configuration diagram illustrating a construction machine according to a second embodiment of the present invention.

As illustrated in FIG. 4, in a construction machine 102 according to the second embodiment of the present invention, the automatic warm-up switch 300 may generate one of a normal warm-up operation signal, a rapid warm-up operation signal, and a fuel efficiency warm-up operation signal. In addition, the control device 700 may select one of a normal mode, a rapid mode, and a fuel efficiency mode according to the type of the warm-up operation signal received from the automatic warm-up switch 300 to perform a warm-up operation. That is, a worker may select one of a normal warm-up operation, a rapid warm-up operation, and a fuel efficiency warm-up operation, as needed.

The normal mode is substantially the same as in the first embodiment described above.

Although the fuel efficiency mode consumes more time to perform the warm-up operation than the normal mode described above, it may be selected to reduce a burden imposed on the hydraulic equipment and to save the fuel consumed in the warm-up operation.

Specifically, when the fuel efficiency mode is selected, the control device 700 delays a point in time at which the number of revolutions of the engine 200 is increased and the bypass cut valve 400 is open as compared to that of the normal mode, or slows down a speed for increasing the number of revolutions of the engine 200 and increasing an opening ratio of the bypass cut valve 400 as compared to that of the normal mode. That is, by reducing a burden imposed on the engine 200 to improve the fuel efficiency of the engine 200, it is possible to reduce the amount of fuel consumed during the warm-up operation.

The rapid mode may reduce the time to perform the warm-up operation over the normal mode described above, but a burden imposed on the hydraulic equipment may be increased and the fuel consumption may be increased. The rapid mode may be selected when the construction machine 102 is to be put into operation in a short period of time. When the rapid mode is selected often, the control device 700 may send a warning signal notifying of adverse effects on the hydraulic equipment through various display methods.

Specifically, when the rapid mode is selected, the control device 700 may lower the first reference temperature and the second reference temperature as compared to those of the normal mode, respectively.

For example, in a case where the first reference temperature is set to be substantially equal to or lower than about 10 degrees Celsius and the second reference temperature is set to be within a range higher than about 10 degrees Celsius and substantially equal to or lower than about 20 degrees Celsius in the normal mode, the first reference temperature may be set to be substantially equal to or lower than about 0 degrees Celsius and the second reference temperature may be set to be within a range higher than about 0 degrees Celsius and substantially equal to or lower than about 10 degrees Celsius in the rapid mode That is, in the rapid mode, the temperature of the working fluid may be raised relatively quickly by forcibly driving the hydraulic pump 800 faster than the normal mode. However, since the hydraulic pump 800 is forcibly driven at a relatively low temperature, it can be of a burden for the hydraulic equipment.

With such a configuration, the construction machine 102 according to the second embodiment of the present invention allows a worker to select one of various patterns for the warm-up operation to automatically raise the temperature of the working fluid to a temperature suitable for the operation of the hydraulic equipment before starting operations.

Hereinafter, a third embodiment of the present invention will be described.

In the case of a construction machine according to the third embodiment of the present invention, in a case where a current altitude at the time of performing a warm-up operation is substantially equal to or higher than a predetermined altitude, the control device 700 slows down a speed for increasing the number of revolutions of the engine 200 and increasing an opening ratio of the bypass cut valve 400 relative to the first embodiment, that is, the normal mode, and sets the first reference temperature and the second reference temperature that determine the forced driving of the hydraulic pump 800 to be respectively lower than those of the first embodiment, that is, the normal mode. In such an embodiment, the predetermined altitude may be substantially equal to or higher than about 3000 m above sea level.

In addition, information on the current altitude may utilize information provided by a global positioning system (GPS) installed in the construction machine. However, the third embodiment of the present invention is not limited thereto, and the control device 700 may obtain altitude information by various methods such as a separately installed altimeter or manual input.

As described above, according to the third embodiment of the present invention, the construction machine may automatically perform an appropriate warm-up operation even at a high altitude and in a low-pressure and low-temperature work environment.

While the present invention has been illustrated and described with reference to the embodiments thereof, it will be apparent to those of ordinary skill in the art that various changes in form and detail may be made thereto without departing from the spirit and scope of the present invention.

It is therefore to be understood that embodiments described above are to be considered in all respects as illustrative only and not restrictive. It should be understood that the scope of the present invention be indicated by the appended claims, and that all changes and modifications derived from the equivalent concept be included within the scope of the present invention.

INDUSTRIAL APPLICABILITY

The embodiments of the present invention may be applicable to a construction machine so that a worker may easily raise the temperature of the working fluid to a temperature suitable for the operation of the hydraulic equipment before starting operations.

The invention claimed is:

1. A construction machine comprising:

one or more hydraulic pumps configured to discharge a working fluid;

an engine configured to supply a rotational power to the one or more hydraulic pumps;

a hydraulic line through which the working fluid discharged by the one or more hydraulic pumps moves;

a main control valve provided on the hydraulic line and configured to control supply of the working fluid to a traveling device or one or more of various working devices, which require the working fluid;

a bypass cut valve provided on the hydraulic line at a lower side thereof than the main control valve to open and close the hydraulic line;

an automatic warm-up switch configured to generate a warm-up operation signal for raising a temperature of the working fluid before an operation starts; and a control device configured to perform a warm-up operation for increasing the number of revolutions of the engine and opening the bypass cut valve to increase a flow rate of the working fluid along the hydraulic line, when the warm-up operation signal is received from the automatic warm-up switch, wherein when the temperature of the working fluid reaches a first predetermined reference temperature after the control device increases the number of revolutions of the engine and opens the bypass cut valve, the control device forcibly adjusts a swash plate angle of the one or more hydraulic pumps to further increase the flow rate and a pressure of the working fluid moving along the hydraulic line.

2. The construction machine of claim 1, further comprising:

an oil tank configured to store the working fluid to be supplied to the one or more hydraulic pumps, and retrieve the working fluid that has been discharged from the one or more hydraulic pumps and is moving along the hydraulic line; and a heating device configured to raise the temperature of the working fluid stored in the oil tank, wherein when the control device receives the warm-up operation signal, the control device is configured to drive the heating device before increasing the number of revolutions of the engine and opening the bypass cut valve.

3. The construction machine of claim 1, further comprising:

a cooling fan configured to receive the rotational power from the engine, wherein when the control device receives the warm-up operation signal, the control device is configured to change the number of revolutions of the cooling fan to a minimum number of revolutions or stop the cooling fan, before opening the bypass cut valve.

4. The construction machine of claim 1, wherein the one or more hydraulic pumps comprise therein an angle sensor configured to measure the swash plate angle, and are electronically controlled by an electric signal generated by the control device, and the control device is configured to forcibly adjust the swash plate angle of the one or more hydraulic pumps based on information transmitted by the angle sensor.

5. The construction machine of claim 1, wherein the automatic warm-up switch is configured to generate one of a normal warm-up operation signal, a rapid warm-up operation signal, and a fuel efficiency warm-up operation signal as the warm-up operation signal, and the control device is configured to select one of a normal mode, a rapid mode, and a fuel efficiency mode according to the type of the warm-up operation signal received from the automatic warm-up switch and perform the warm-up operation.

6. The construction machine of claim 5, wherein when the normal mode is selected, the control device is configured to:

increase the number of revolutions of the engine and an opening ratio of the bypass cut valve stepwisely, as the temperature of the working fluid increases, forcibly drive the one or more hydraulic pumps to discharge the working fluid at a flow rate and a pressure that are lower than a maximum flow rate and a maximum pressure, respectively, when the temperature of the working fluid reaches the first reference temperature after the number of revolutions of the engine is increased and the bypass cut valve is opened, and stepwisely increase the flow rate and the pressure of the working fluid discharged from the one or more hydraulic pumps to the maximum flow rate and the maximum pressure, respectively, when the temperature of the working fluid reaches a second reference temperature that is higher than the first reference temperature.

7. The construction machine of claim 6, wherein when the fuel efficiency mode is selected, the control device is configured to delay a point in time for increasing the number of revolutions of the engine and opening the bypass cut valve as compared to that in the normal mode, or slow down a speed for increasing the number of revolutions of the engine and increasing the opening ratio of the bypass cut valve as compared to that in the normal mode.

8. The construction machine of claim 6, wherein when the rapid mode is selected, the control device is configured to change the first reference temperature and the second reference temperature so that the first reference temperature and the second reference temperature of the rapid mode become lower than those in the normal mode, respectively.

9. The construction machine of claim 6, wherein in a case where a current altitude at the time of performing the warm-up operation is substantially equal to or higher than a predetermined altitude, the control device is configured to slow down a speed for increasing the number of revolutions of the engine and increasing the opening ratio of the bypass cut valve as compared to that in the normal mode, and lower the first reference temperature and the second reference temperature than those in the normal mode, respectively.

10. The construction machine of claim 6, wherein the second reference temperature is higher than 10° C. and equal to or lower than 20° C.

11. The construction machine of claim 1, wherein the first reference temperature is 10° C.

12. A construction machine comprising:

one or more hydraulic pumps configured to discharge a working fluid;

an engine configured to supply a rotational power to the one or more hydraulic pumps;

a hydraulic line through which the working fluid discharged by the one or more hydraulic pumps moves;

a main control valve provided on the hydraulic line and configured to control supply of the working fluid to a traveling device or one or more of various working devices, which require the working fluid;

a bypass cut valve provided on the hydraulic line at a lower side thereof than the main control valve to open and close the hydraulic line;

an automatic warm-up switch configured to generate a warm-up operation signal for raising a temperature of the working fluid before an operation starts;

a control device configured to perform a warm-up operation for increasing the number of revolutions of the engine and opening the bypass cut valve to increase a flow rate of the working fluid along the hydraulic line, when the warm-up operation signal is received from the automatic warm-up switch;

an oil tank configured to store the working fluid to be supplied to the one or more hydraulic pumps, and retrieve the working fluid that has been discharged from the one or more hydraulic pumps and is moving along the hydraulic line;

a heating device configured to raise the temperature of the working fluid stored in the oil tank; and a cooling fan configured to receive the rotational power from the engine, wherein when the control device receives the warm-up operation signal, the control device is configured to firstly drive the heating device, and change the number of revolutions of the cooling fan to a minimum number of revolutions or stop the cooling fan, before increasing the number of revolutions of the engine and opening the bypass cut valve, wherein the one or more hydraulic pumps comprise therein an angle sensor configured to measure a swash plate angle, and are electronically controlled by an electric signal generated by the control device, and wherein when the temperature of the working fluid reaches a first predetermined reference temperature after the control device increases the number of revolutions of the engine and opens the bypass cut valve, the control device is configured to forcibly adjust the swash plate angle of the one or more hydraulic pumps based on information transmitted by the angle sensor to further increase the flow rate and a pressure of the working fluid moving along the hydraulic line.

13. The construction machine of claim 12, wherein when a normal mode is selected, the control device is configured to:

increase the number of revolutions of the engine and an opening ratio of the bypass cut valve stepwisely, as the temperature of the working fluid increases, forcibly drive the one or more hydraulic pumps to discharge the working fluid at a flow rate and a pressure that are lower than a maximum flow rate and a maximum pressure, respectively, when the temperature of the working fluid reaches the first reference temperature after the number of revolutions of the engine is increased and the bypass cut valve is opened, and stepwisely increase the flow rate and the pressure of the working fluid discharged from the one or more hydraulic pumps to the maximum flow rate and the maximum pressure, respectively, when the temperature of the working fluid reaches a second reference temperature that is higher than the first reference temperature.

14. The construction machine of claim 13, wherein when a fuel efficiency mode is selected, the control device is configured to delay a point in time for increasing the number of revolutions of the engine and opening the bypass cut valve as compared to that in the normal mode, or slow down a speed for increasing the number of revolutions of the engine and increasing the opening ratio of the bypass cut valve as compared to that in the normal mode.

15. The construction machine of claim 13, wherein when a rapid mode is selected, the control device is configured to change the first reference temperature and the second reference temperature so that the first reference temperature and the second reference temperature of the rapid mode is lower than those in the normal mode, respectively.

16. The construction machine of claim 13, wherein the second reference temperature is higher than 10° C. and equal to or lower than 20° C.

17. The construction machine of claim 12, wherein the first reference temperature is 10° C.

* * * * *